United States Patent [19]

Nakamura et al.

[11] Patent Number: 4,600,687

[45] Date of Patent: Jul. 15, 1986

[54] PHOTOGRAPHIC LIGHT-SENSITIVE MATERIAL

[75] Inventors: Taku Nakamura; Mitsunori Hirano; Masasi Ogawa; Kunio Ishigaki, all of Kanagawa, Japan

[73] Assignee: Fuji Photo Film Co., Ltd., Kanagawa, Japan

[21] Appl. No.: 725,684

[22] Filed: Apr. 22, 1985

Related U.S. Application Data

[63] Continuation of Ser. No. 251,827, Apr. 7, 1981, abandoned.

[30] Foreign Application Priority Data

Apr. 7, 1980 [JP] Japan ..... 55-45412

[51] Int. Cl.[4] ..... G03C 1/76; G03C 1/86

[52] U.S. Cl. ..... 430/529; 430/518; 430/523; 430/527; 430/539; 430/621; 430/629; 430/631; 430/636

[58] Field of Search ..... 430/518, 527, 529, 621, 430/629, 631, 636, 523, 961, 539

[56] References Cited

U.S. PATENT DOCUMENTS 4,161,407 7/1979 Campbell ..... 430/529

4,193,795 3/1980 Campbell ..... 430/529

*Primary Examiner*—Jack P. Brammer

*Attorney, Agent, or Firm*—Sughrue, Mion, Zinn, Macpeak & Seas

[57] ABSTRACT

A photographic light-sensitive material having at least one layer containing a polymer having a repeating unit of the formula (I):

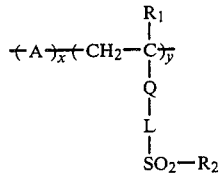

(I)

wherein A is a monomer unit prepared by copolymerizing copolymerizable ethylenically unsaturated monomers; $R_1$ is hydrogen or a lower alkyl group having 1 to 6 carbon atoms; Q is

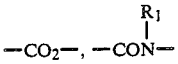

(wherein $R_1$ is the same as defined above) or an arylene group having 6 to 10 carbon atoms; L is a divalent group having 3 to 15 carbon atoms and containing at least one linking group selected from the members consisting of

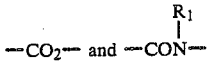

(wherein $R_1$ is the same as defined above) or a divalent group having 1 to 12 carbon atoms and containing at least one linking group selected from the members consisting of

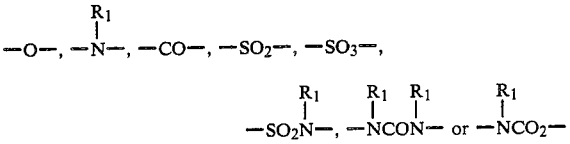

(wherein $R_1$ is the same as defined above); $R_2$ is $-CH=CH_2$ or $-CH_2CH_2X$ (wherein X is a group capable of being substituted with a nucleophilic group or a group capable of being released in the form of HX upon a base; and x and y each represents molar percent, x being between 0 and 99 and y being between 1 and 100. The polymer has a vinylsulfone group or a functional group which is a precursor of a vinylsulfone group fixed in a specific layer of the photographic light-sensitive material and can be used as a mordant, an antistatic agent or other various photographic additives.

16 Claims, No Drawings

PHOTOGRAPHIC LIGHT-SENSITIVE MATERIAL

This is a continuation of application Ser. No. 06/251,827, filed Apr. 7, 1981 abandoned.

FIELD OF THE INVENTION

The present invention relates to a photographic light sensitive material, more particularly, to a photographic light sensitive material containing a reactive polymer in which a vinylsulfone group or functional group which is a precursor of vinylsulfone group is connected to the main chain thereof through a long flexible linking group.

BACKGROUND OF THE INVENTION

It is known to incorporate various polymers in a photographic system as mordants, antistatic agents, neutralizing agents, thickeners and sensitizers. However, these polymers, particularly when they are water-soluble, diffuse from a coated layer to an adjacent layer(s) and can adversely affect the properties of a photographic film (e.g., increase fogging, lower sensitivity and cause dye image spreading). To prevent this, mordants are rendered non-diffusable by incorporating therein a functional group reactive with gelatin (as described in U.S. Pat. No. 3,625,694) or by incorporating therein a functional group that reacts with a crosslinking agent (as described in U.S. Pat. No. 3,859,096).

However, the reactivity of functional groups incorporated in mordants of this type is low. Furthermore, it has been difficult to obtain non-diffusable mordants by a reaction with gelatin or a crosslinking agent before diffusion occurs.

Unfortunately, the prior art has not disclosed polymers having incorporated therein a highly reactive functional group that quickly reacts with gelatin or a crosslinking agent to render the polymer non-diffusable.

One technique is known to bind various photographic additives to certain polymers to thereby fix them in a layer where they are added or make them non-diffusable.

The term "photographic additives" as used herein means additives conventionally used in photographic systems such as dyes, dye precursors, development restrainers, development accelerators, couplers, developing agents, auxiliary developer agents, bleaching restrainers, bleaching accelerators, silver halide solvents, silver complexing agents, foggants, anti-foggants, chemical sensitizers, spectral sensitizers, desensitizers, hardening agents, hardening accelerators, gelatin, surfactants, anti-static agents, and the like.

Reactive polymers have been used in diffusion transfer to fix a diffusing dye within a photographic element. For example, mordants as described in U.S. Pat. Nos. 3,709,690, 3,898,088 and 3,958,995, will fix a dye in diffusion transfer. However, these mordants are cationic and fix anionic dyes by mutual electrostatic interaction. Furthermore, their fixing ability is not always satisfactory because it is reduced by water in the photographic system or decreased pH and the fixed dye easily fades upon exposure to sunlight or fluorescent light.

To eliminate these defects, a mordant that will fix certain dyes via covalent bonds is described in U.S. Pat. No. 4,193,795. While this mordant is a good mordant for the specific types of dyes described in British Pat. No. 1,464,104 and U.S. Pat. No. 4,199,355, it is not applicable to other dyes. In addition, the mordant does not fix the dyes at a high enough speed and is difficult to synthesize.

Therefore, the development of a mordant which rapidly and positively fixes diffused dyes, prevents the fixed dye from fading upon exposure to light and which is easy to synthesize on a large scale has been desired in the art.

Further, most photographic light sensitive materials contain gelatin as a component. For example, a silver halide photosensitive emulsion layer, an emulsion protective layer, a filter layer, an intermediate layer, an antihalation layer, a backing layer, a subbing layer on film base and a baryta layer use gelatin as a primary component. These gelatin-containing light-sensitive materials are processed with various aqueous solutions at different pHs and/or temperatures. However, a gelatin-containing layer untreated with a hardener has low resistance to water and is easily scratched after swelling in an aqueous solution. In an extreme case, a gelatin layer may even dissolve out in a processing solution having a temperature of 30° C. or more.

A number of compounds are known to be effective for hardening gelatin and increasing its water resistance, heat resistance and scratch resistance when used in a gelatin layer. These compounds are known as hardening agents used in the production of photographic materials. Examples of such compounds include inorganic compounds such as chrome alum and organic compounds such as aldehyde compounds such as formaldehyde and glutaraldehyde, compounds having an active halogen as described in U.S. Pat. No. 3,288,775, etc., compounds having a reactive ethylenically unsaturated group as described in U.S. Pat. No. 3,635,718, etc., aziridine compounds as described in U.S. Pat. No. 3,017,280, etc., epoxy compounds as described in U.S. Pat. No. 3,091,537, etc., and halogenocarboxyaldehyde such as mucochloric acid. However, these hardening agents have one or more of the following defects: (1) they have an adverse effect on the properties of a photosensitive material (e.g., increase fogging, lower sensitivity or change gradation); (2) cause "after-hardening" wherein the hardening effect changes upon extended storage; (3) are not adequately dissolved in water and cause lack of uniformity of the additives dispersed in the photographic layer; (4) lose their hardening effect depending upon the photographic additive used therewith (e.g., a color coupler for color photosensitive materials); (5) are unstable and do not keep long, or; (6) are difficult to synthesize in large quantities.

A hardener of low molecular weight as is frequently used in hardening gelatin also will diffuse in a gelatin layer so that it is impossible to control the degree of hardening of laminated gelatin layers on a film base. Commonly used polymeric non-diffusable gelatin hardening agents such as dialdehyde starch and polyacrolein are not satisfactory for use in a photosensitive material because they have adverse effects on photographic characteristics, such as increasing fog and lowering sensitivity. The polymeric hardening agents described in U.S. Pat. No. 4,161,407 which have a vinyl sulfone group as an active group cause after-hardening, that is, they harden a gelatin layer only slowly and the degree of swelling Q (defined hereunder) changes with time.

Therefore, the development of a hardening agent that does not cause after-hardening and which does not have any adverse effect on photographic characteristics has long been desired in the art.

SUMMARY OF THE INVENTION

Therefore, one object of this invention is to provide a photographic light-sensitive material containing a photographic polymer which has been rendered non-diffusable by incorporating therein a highly reactive functional group.

Another object is to provide a photographic light-sensitive material wherein a photograhic additive having a nucleophilic group is securely fixed to a desired photographic layer or rendered non-diffusable in that layer.

A further object is to provide a dye mordant advantageously used in a photographic light sensitive material to be processed by diffusion transfer.

A still further object is to provide a non-diffusable gelatin hardening agent that hardens gelatin quickly and has high solubility.

Another object of this invention is to provide a method for making a photographically useful non-diffusable polymer.

Still another object is to provide a method for fixing a photographic additive having a nucleophilic group or rendering the additive non-diffusable.

The objects are achieved by a photographic light-sensitive material having at least one layer containing a polymer having a repeating unit of the formula (I)

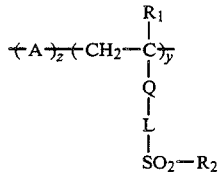

(I)

wherein A is a monomer unit prepared by copolymerizing copolymerizable ethylenically unsaturated monomers; $R_1$ is hydrogen or a lower alkyl group having 1 to 6 carbon atoms; Q is

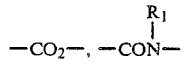

(wherein $R_1$ is the same as defined above) or an arylene group having 6 to 10 carbon atoms; L is a divalent group having 3 to 15 carbon atoms and containing at least one linking group selected from the members consisting of

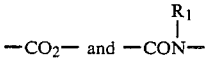

(wherein $R_1$ is the same as defined above) or a divalent group having 1 to 12 carbon atoms and containing at least one linking group selected from the members consisting of

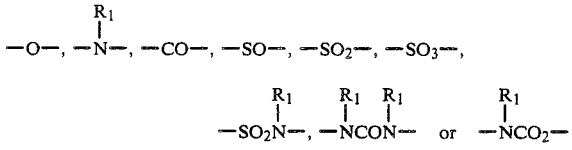

(wherein $R_1$ is the same as defined above); $R_2$ is $-CH{=}CH_2$ or $-CH_2CH_2X$ (wherein X is a group capable of being substituted with a nucleophilic group or a group capable of being released in the form of HX upon reaction with a base; and z and y are each molar percent, z being between 0 and 99 and y being between 1 and 100.

DETAILED DESCRIPTION OF THE INVENTION

Examples of ethylenically unsaturated monomers include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids (e.g., vinyl acetate and allyl acetate), ethylenically unsaturated mono- or dicarboxylic acids and salts thereof (e.g., acrylic acid, methacrylic acid, itaconic acid, maleic acid, sodium acrylate, potassium acrylate and sodium methacrylate), maleic anhydride, esters of ethylenically unsaturated monocarboxylic or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N-diethyl-N-methyl-N-methacryloyloxyethylammonium-p-toluene sulfonate, dimethyl itaconate and monobenzyl maleate), and amides of ethylenically unsaturated monocarboxylic or dicarboxylic acids (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, methacrylamide, N,N-dimethyl-N'-acryloyl propane diamine propionate betaine, and N,N-dimethyl-N'-methacryloyl propane diamine acetate betaine).

Monomer unit "A" is selected dependant upon the use of the polymer of this invention (i.e., whether it is used as a mordant in diffusion transfer, an antistatic agent or a hardening agent) and its properties (e.g., solubility, glass transition point or whether it is cationic, anionic or nonionic). To provide a polymer having more than one function, "A" may be comprised of two or more monomer units. For instance, if the polymer is used as an antistatic agent, "A" is preferably a cationic monomer or an anionic monomer. If the polymer is used as a mordant, "A" is preferably a cationic monomer. To provide a polymer having increased water solubility, "A" is preferably an ionic monomer, acrylamide or N-vinyl pyrrolidone. If the polymer of this invention is used as a crosslinked latex, "A" includes not only the monoethylenically unsaturated monomers defined above but also monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate and neopentyl glycol dimethacrylate).

$R_1$ can be hydrogen or any lower alkyl group having 1 to 6 carbon atoms (e.g., a methyl group, an ethyl group, a butyl group or an n-hexyl group). However, it is particularly preferred that $R_1$ be hydrogen or a methyl group.

Q can be $$-CO_2-,\ -\overset{\overset{R_1}{|}}{C}ON-$$

(wherein $R_1$ is the same as defined above) or an arylene group having 6 to 10 carbon atoms.

Among Q, $$-CO_2-\ \text{and}\ -\overset{\overset{R_1}{|}}{C}ON-$$

are preferred in case that a hydrophilic polymer is desired to obtain, but the arylene group is preferred in case that a hydrophobic polymer is desired to obtain.

Specific examples of Q include the following groups:

$$-CO_2-,\ -CONH-,\ -\overset{\overset{CH_3}{|}}{C}ON-,\ -\overset{\overset{C_2H_5}{|}}{C}ON-,\ -\overset{\overset{nC_4H_9}{|}}{C}ON-,$$

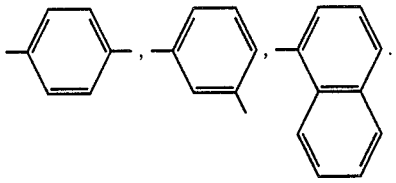

Of these groups, $-CO_2-,\ -CONH-,$ 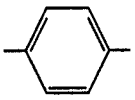 and 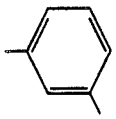

are particularly preferred.

L can be any divalent group having 3 to 15 carbon atoms and containing at least one linking group selected from the members consisting of $$-O-,\ -\overset{\overset{R_1}{|}}{N}-,\ -CO-,\ -SO-,\ -SO_2-,\ -SO_3-,$$

$$-SO_2\overset{\overset{R_1}{|}}{N}-,\ -\overset{\overset{R_1}{|}}{N}C\overset{\overset{R_1}{|}}{O}N-\ \text{and}\ -\overset{\overset{R_1}{|}}{N}CO_2-$$

$$-CO_2-\ \text{and}\ -\overset{\overset{R_1}{|}}{C}ON-$$

(wherein $R_1$ is the same as defined above) or a divalent group having 1 to 12 carbon atoms and containing at least one linking group selected from the members consisting $$-O-,\ -\overset{\overset{R_1}{|}}{N}-,\ -CO-,\ -SO-,\ -SO_2-,\ -SO_3-,$$

-continued $$-SO_2\overset{\overset{R_1}{|}}{N}-,\ -\overset{\overset{R_1}{|}}{N}C\overset{\overset{R_1}{|}}{O}N-\ \text{and}\ -\overset{\overset{R_1}{|}}{N}CO_2-$$

(wherein $R_1$ has the same meaning as defined above).

Among L, the divalent group containing at least $$-CO_2-\ \text{and}\ -\overset{\overset{R_1}{|}}{C}ON-$$

is preferred and the divalent group containing at least $$-\overset{\overset{R_1}{|}}{C}ON-$$

is more preferred, in addition, the divalent group containing at least —O— or $-SO_2-$ is preferred.

Specific examples of L include the following groups:

$$-CH_2CO_2CH_2-,\ -CH_2CO_2CH_2CH_2-,$$
$$-CH_2CH_2CO_2CH_2CH_2-,\ -(CH_2)_5CO_2CH_2CH_2-,$$
$$-(CH_2)_{10}CO_2CH_2CH_2-,\ -CH_2NHCOCH_2-,$$
$$-CH_2NHCOCH_2CH_2-,\ -(CH_2)_3NHCOCH_2CH_2-,$$

$$-(CH_2)_5NHCOCH_2CH_2-,\ -(CH_2)_{10}NHCOCH_2CH_2-,$$

$$-CH_2OCH_2-,\ -CH_2CH_2OCH_2CH_2CH_2-,\ -\overset{\overset{CH_3}{|}}{N}CH_2CH_2-,$$

$$-CH_2\overset{\overset{CH_3}{|}}{N}CH_2CH_2-,\ -COCH_2CH_2-,\ -CH_2COCH_2CH_2-,$$

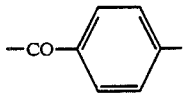

$$-CH_2SOCH_2CH_2-,\ -SO_2CH_2CH_2-,$$

$$-SO_2CH_2CH_2SO_2CH_2CH_2-,\ -SO_2CH_2CH_2SO_2CH_2\underset{\underset{OH}{|}}{C}HCH_2-,$$

$$-SO_3CH_2CH_2CH_2-,\ -SO_3CH_2CO_2CH_2CH_2-,$$
$$-SO_3CH_2CH_2CO_2CH_2CH_2-,\ -SO_2NHCH_2CO_2CH_2CH_2-,$$
$$-SO_2NHCH_2CH_2CO_2CH_2CH_2-,\ -NHCONHCH_2CH_2-,$$
$$-CH_2NHCONHCH_2CH_2-,\ -NHCO_2CH_2CH_2-,$$
$$-CH_2NHCO_2CH_2CH_2-.$$

L can be freely selected depending upon the purpose of the present invention. For example, L can be selected to provide a diffusion resistant photographic polymer, to render a photographic additive having a nucleophilic group diffusion resistant, or to use the polymer as a hardening agent. Also, L can be freely selected depending upon the properties of the polymer (for example, cationic property, anionic property, nonionic property, solubility, hydrophilic property, hydrophobic property or glass transition point) or the form of the polymer (for example, a watersoluble polymer or a polymer dispersion (latex)).

In more detail, the reaction of a nucleophilic agent with the $-SO_2-R_2$ group connected to the main chain of the polymer is controlled with entropy and is subjected to a large steric hindrance due to the main chain of the polymer. Therefore, the selection of a long ring of L may moderate the steric hindrance of the —SO- $_2$—$R_2$ group due to the main chain of the polymer and thus increase the reactivity of the —$SO_2$—$R_2$ group with a nucleophilic group. By including a long size L in the polymer, the reactivity of the —$SO_2$—$R_2$ group connected to the main chain of the polymer is increased and the purposes of the present invention are achieved. On the contrary, the polymeric mordant described in Japanese Patent Application (OPI) No. 65033/79 ("OPI" as used herein refers to a "published unexamined Japanese patent application.) or the polymeric hardening agent described in U.S. Pat. No. 4,161,407 can not sufficiently accomplish the purposes of the present invention due to the shortness of the part corresponding to L.

$R_2$ can be a vinyl group or a functional group which is a precursor of a vinyl group, that is, —CH=$CH_2$ or —$CH_2CH_2X$ wherein X represents a group capable of being substituted with a nucleophilic group or a group capable of being released in the form of HX upon a base.

Specific examples of $R_2$ include the following groups:

—CH=$CH_2$, —$CH_2CH_2Cl$, —$CH_2CH_2Br$, —$CH_2CH_2O_3SCH_3$,

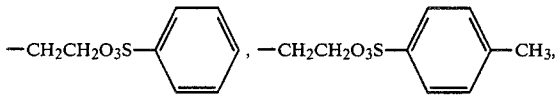

—$CH_2CH_2OH$, —$CH_2CH_2O_2CCH_3$, —$CH_2CH_2O_2CCF_3$, —$CH_2CH_2O_2CCHCl_2$.

Of these groups,

—CH=$CH_2$, —$CH_2CH_2Br$, —$CH_2CH_2Cl$,

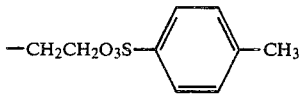

are particularly preferred.

z and y each represents molar percent, z being between 0 and 99 and y being between 1 and 100. z and y can be freely selected depending upon the purpose of the present invention. For example, in order to provide a diffusion resistant photographic polymer, z is between 50 and 99 and y is between 1 and 50. In order to render a photographic additive having a nucleophilic group diffusion resistant or to be useful as a hardening agent z is between 0 and 75 and y is between 25 and 100.

Of the polymers having a repeating unit represented by the formula (I), a polymer in which $R_2$ is a precursor of a vinyl group can be generally obtained by polymerizing an ethylenically unsaturated monomer A described above with an ethylenically unsaturated monomer represented by the formula (II):

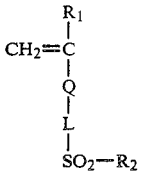

(II)

wherein $R_1$, Q, L and $R_2$ are each the same as defined above. Also, a polymer in which $R^2$ is a vinyl group can be easily obtained by treating a polymer in which $R^2$ is a precursor of a vinyl group which a base, for example, triethylamine, pyridine, etc.

Preferred examples of ethylenically unsaturated monomers represented by the formula (II) are set forth below, but the present invention should not be construed as being limited to these examples.

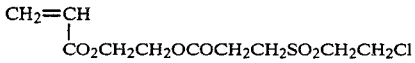

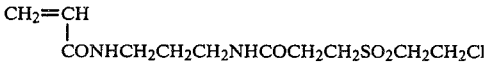

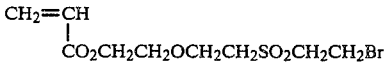

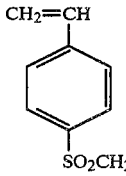

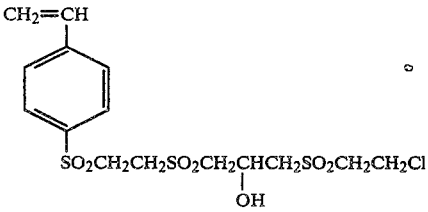

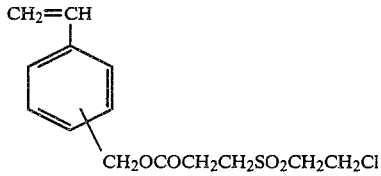

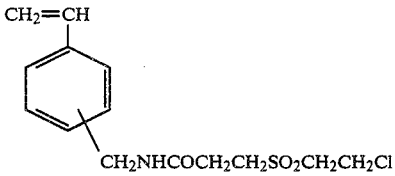

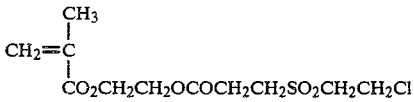

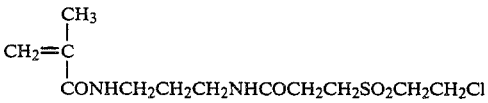

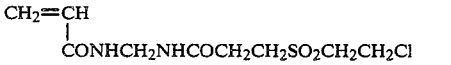

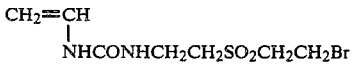

-continued

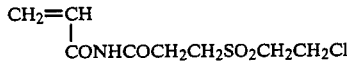

The synthesis of typical ethylenically unsaturated monomers having a vinyl sulfone group or a functional group which is a precursor of a vinyl sulfone group is illustrated below by specific examples.

SYNTHESIS EXAMPLE 1

Synthesis of
2-[3-(chloroethylsulfonyl)propioyloxy]ethyl acrylate (M-1)

600 ml of tetrahydrofuran, 45.8 g of hydroxyethyl acrylate and 72 g of 3-(2-chloroethylsulfonyl)propionic acid chloride were put into a reaction vessel. A solution containing 31.2 g of pyridine dissolved in 100 ml of tetrahydrofuran was added to the mixture dropwise over a period of 1.75 hours at a temperature below 5° C. under cooling with ice water. Then the mixture was stirred for 2 hours at room temperature and the reaction mixture was poured into 2.5 liter of ice water. The mixture was extracted four times with each of 300 ml of chloroform. The organic solvent layer was dried with sodium sulfate and concentrated to obtain 87 g of 2-[3-(chloroethylsulfonyl)propioyloxy]ethyl acrylate (yield: 88%).

SYNTHESIS EXAMPLE 2

Synthesis of
[3-(chloroethylsulfonyl)propioyl]aminomethyl styrene (M-2)

100 ml of tetrahydrofuran, 20.1 g of vinyl benzyl amine, 16.7 g of triethylamine and 0.1 g of hydroquinone were put into a reaction vessel. A solution containing 36.1 g of β-chloroethylsulfonylpropionic said chloride dissolved in 200 ml of tetrahydrofuran was added to the mixture dropwise over a period of 30 minutes under cooling with ice water. The mixture was allowed to stand over night at room temperature. The reaction mixture was poured into a solution containing 16.5 g of concentrated hydrochloric acid diluted with 1.5 liter of ice water and the precipitate thus formed was collected by filtration. The precipitate was recrystallized from a solvent mixture of 200 ml of ethanol and 200 ml of water to obtain 26.8 g of N-vinylbenzyl-β-chloroethylsulfonylpropionic acid amide (yield: 57%).

Elemental Analysis Found: H: 5.74; C: 53.47; N: 4.83; Cl: 10.99; S: 10.49

SYNTHESIS EXAMPLE 3

Synthesis of
1-{[2-(4-vinylbenzenesulfonyl)ethyl]sulfonyl}-3-chloroethylsulfonyl-2-propanol (M-3)

157 g of 1,3-bischloroethylsulfonyl-2-propanol (refer to the synthesis method described in British Pat. No. 1,534,455), 1 liter of methanol and 1 liter of distilled water were put into a reaction vessel. A solution containing 52 g of potassium vinylbenzene sulfinate dissolved in 100 ml of methanol and 100 ml of distilled water was added to the mixture dropwise over a period of 1 hour under heating at 46° C. The mixture was stirred for 5.5 hours maintaining the temperature at 46° C. The precipitate formed was collected by filtration to obtain 55 g of 2-(1-vinylbenzenesulfonyl)ethylsulfonyl-3-chloroethylsulfonyl-2-propanol (yield: 49%).

Elemental Analysis Found: H: 4.67; C: 39.89; S: 21.43

The synthesis of typical polymers according to the present invention is illustrated below by specific examples.

SYNTHESIS EXAMPLE 4

Synthesis of
poly{2-[3-(chloroethylsulfonyl)propioyloxy]ethylacrylate-co-sodium-acrylamide-2-methylpropanesulfonate} (P-1)

60 ml of N,N-dimethylformamide, 14.5 g of 2-[3-(chloroethylsulfonyl)propioyloxy]ethyl acrylate (M-1) and 23.5 g of acrylamido-2-methylpropanesulfonic acid were put into a reaction vessel. After the atmosphere of the reaction vessel was replaced with nitrogen gas, the mixture was heated at 60° C., 0.40 g of 2,2'-azobis(2,4-dimethylvaleronitrile) was added thereto and further heated for 2 hours with stirring. Then 0.2 g of 2,2'-azobis(2,4-dimethylvaleronitrile) was further added to the mixture and the mixture was heated for 2 hours with stirring. After cooling to 5° C., 12 g of sodium carbonate and 4.9 g of triethylamine were added to the mixture, which was stirred for 1 hour. Then the mixture was further stirred at room temperature for 1 hour. The reaction mixture was put into a cellulose tube, dialysed for 2 days and freeze dried to obtain 35 g of a white polymer (yield: 95%). The vinyl sulfone content in the polymer was $0.51\times10^{-3}$ eq./g.

SYNTHESIS EXAMPLE 5

Synthesis of
poly-{2-[3-(chloroethylsulfonyl)propioyloxy]ethyl acrylate-co-N,N,N-trimethyl-N-(N-acryloylpropyl)ammonium-p-toluene sulfonate} (P-2)

80 ml of N,N-dimethylformamide 14.5 g, of 2-[3-(chloroethylsulfonyl)propioyloxy]ethyl acrylate (M-1) and 17.2 g of N,N,N-trimethyl-N-(N-acryloylpropyl-)ammonium-p-toluene sulfonate were put into a reaction vessel. After the atmosphere of the reaction vessel was replaced with nitrogen gas, the mixture was heated at 60° C., 0.24 g of 2,2'-azobis(2,4-dimethylvaleronitrile) was added thereto and further heated for 3 hours with stirring. Then 0.12 g of 2,2'-azobis(2,4-dimethylvaleronitrile) was further added to the mixture and the mixture was heated for 2 hours with stirring. After cooling to 5° C., 4.9 g of triethylamine was added to the mixture and stirred for 1 hour to room temperature. After filtration, the filtrate was poured into 600 ml of ethyl acetate and the precipitate thus formed was collected by filtration to obtain 19 g of a white polymer (yield: 59%). The vinylsulfone content in the polymer was $2.0\times10^{-3}$ eq./g.

SYNTHESIS EXAMPLE 6

Synthesis of
poly{[3-(chloroethylsulfonyl)propioyl]aminomethyl styrene-co-sodium-acrylamido-2-methylpropane sulfonate} (p-3)

15.8 g of [3-(chloroethylsulfonyl)propioyl-]aminomethyl styrene (M-2), 23.6 g of sodium acrylamido-2-methylpropane sulfonate and 75 ml of N,N-dimethylformamide were put into a reaction vessel. After the atmosphere of the reaction vessel was replaced with nitrogen gas, the mixture was heated at 80° C., 0.75 g of 2,2'-azobis(2,4-dimethylvaleronitrile) was added thereto and further heated for 3 hours with stirring. Then 25 ml of N,N-dimethylformamide was added to the mixture and 6.1 g of triethylamine was added dropwise at room temperature and further stirred for 1 hour. The mixture was filtered, the filtrate was poured into 800 ml of acetone. The precipitate thus formed was collected by filtration and dried to obtain 36.2 g of a light yellow polymer (yield: 94%). The vinyl sulfone content in the polymer was $0.80\times10^{-3}$ eq./g.

SYNTHESIS EXAMPLE 7

Synthesis of poly-[1-{[2-(4-vinylbenzenesulfonyl)ethyl]sulfonyl}-3-chloroethylsulfonyl-2-propanol-co-sodium-acrylate] (P-4)

300 ml of N,N-dimethylformamide, 40.1 g of 2-(1-vinylbenzenesulfonyl)ethylsulfonyl-3-chloroethylsulfonyl-2-propanol and 13.0 g of acrylic acid were put into a reaction vessel. After the atmosphere of the reaction vessel was replaced with nitrogen gas, the mixture was heated at 70° C., 0.53 g of 2,2'-azobis(2,4-dimethylvaleronitrile) was added thereto and further heated for 1.5 hours with stirring. Then 0.53 g of 2,2'-azobis(2,4-dimethylvaleronitrile) was added to the mixture and the mixture was heated for 1 hour with stirring. After cooling to room temperature, 54.8 g of a 28% methanol solution of sodium methlate was added dropwise to the mixture and the mixture was continually stirred for 1 hour. The reaction mixture was put into a cellulose tube, dialysed for 2 days and freeze dried to obtain 30 g of a light yellow polymer (yield: 56%). The vinyl sulfone content in the polymer was $1.4\times10^{-3}$ eq./g.

The characteristics of the vinyl sulfone polymers synthesized by the above procedure are listed in Table 1 below.

TABLE 1

Synthesis of Vinyl Sulfone Polymers

| | Ethylenically Unsaturated Monomer | Vinyl Sulfone Monomer | z:y (Molar Ratio) | Yield % | Vinyl Sulfone Content (eq./g) |
|---|---|---|---|---|---|
| P-1 | $-CH_2-CH-$ (CONHC(CH3)2-CH2SO3⊖Na⊕) | $-CH_2-CH-$ (CO-OCH2CH2OCOCH2CH2SO2CH=CH2) | 2:1 | 95 | $0.51\times10^{-3}$ |
| P-2 | $-CH_2-CH-$ (CONH-(CH2)3-N⊕(CH3)3, p-TSO⊖) | " | 3:2 | 59 | $2.0\times10^{-3}$ |
| P-3 | $-CH_2-CH-$ (CONHC(CH3)2-CH2SO3⊖Na⊕) | $-CH_2-CH-$ (C6H4-CH2NHCOCH2CH2SO2CH=CH2) | 2:1 | 94 | $0.80\times10^{-3}$ |
| P-4 | $-CH_2-CH-$ ($CO_2Na$) | $-CH_2-CH-$ (C6H4-SO2CH2CH2SO2CH2CH(OH)CH2SO2CH=CH2) | 2:1 | 56 | $1.4\times10^{-3}$ |

As noted before, the presence of a highly reactive vinyl sulfone group in the polymer of this invention enables the polymer to be used in a photographic system as various additives listed below:

(i) polymeric mordant, antistatic agent, neutralizing agent, thickener or sensitizer required to be non-diffusable;

(ii) polymer for fixing or rendering non-diffusable a photographic additive having a nucleophilic group such as amino, phenolic hydroxyl, or sulfonamide group; and (iii) gelatin hardening agent.

The polymer of this invention is used in an amount and in a location in a photographic element as is conventional for the purposes (i), (ii) and (iii) described above. For example, the polymer of this invention is used in the same amount and in the same location in a photographic element as in U.S. Pat. Nos. 3,232,764, 3,819,608, 3,542,558, 3,106,468 and 3,325,287 for the purpose of the gelatin hardening agent; as in U.S. Pat. Nos. 3,455,693, 3,756,814 and 4,154,615 for the purpose of the polymeric mordant; as in U.S. Pat. No. 3,615,531 for the purpose of the antistatic agent; and as in U.S. Pat. Nos. 3,362,819, 3,756,815 and 4,149,890 for the purpose of the neutralizing agent.

The utility of the polymer of this invention is hereunder described assuming that it is used as a gelatin hardening agent. When the polymer of this invention is used as a hardening agent, the amount used can be freely selected depending upon the objective. Usually, the polymer is used in an amount such that it contains from $0.5\times10^{-3}$ to $5\times10^{-2}$ eq. of vinyl sulfone group per 100 g of dry gelatin. A particularly preferred range is from $5\times10^{-3}$ to $5\times10^{-2}$ eq. per 100 g of dry gelatin.

The polymer of this invention may be used as a hardening agent independently or in combination with other low molecular or high molecular weight hardening agents. Examples of such low or high molecular weight hardening agents are compounds such as 2-hydroxy-4,6-dichloro-1,3,5-triazine which have a reactive halogen atom, compounds such as divinyl sulfone which have a reactive olefin bond, isocyantes, aziridines, epoxy compounds, mucochloric acid, chrome alum and aldehydes.

The reactive polymer of this invention that has a vinyl sulfone group as a pendant group quickly hardens gelatin because of its high reactivity; hence it is free from "after-hardening". In addition, its solubility can be controlled by properly selecting the copolymerizable monomer. Since the polymer is non-diffusable, it controls the degree of hardening of individual laminated gelatin layers on a film base according to the level. As a further advantage, the polymer of this invention has no adverse effect on photographic characteristics.

There is no particular limitation on the silver halide, chemical sensitizer, silver halide solvent, spectral sensitizing dye, antifoggant, protective colloid such as gelatin, UV absorber, polymer latex, whitening agent, color coupler, anti-discoloration agent, dye, matting agent, surfactant and other additives incorporated in the silver halide emulsion layer or other layers of the photographic material of this invention, and reference can be made to, for example, *Research Disclosure,* 176, pp. 22–31 (December, 1978) thereof. Reference can also be had to *Research Disclosure ibid. for the support of the photographic material, methods of development, and layers that constitute a photographic material for diffusion transfer.*

The photographic emulsion(s) used in this invention can be prepared by a conventional method such as described in P. Glafkides, *Chimie et Physique Photographique,* Paul Montel, (1967), G. F. Duffin, *Photographic Emulsion Chemistry,* The Focal Press (1966), and V. L. Zelikman et al., *Making the Coating Photographic Emulsion,* The Focal Press (1964). Therefore, either the acid method, neutral method or ammoniacal method may be employed. A soluble silver salt may be reacted with a soluble halide salt by the single-jet or double-jet method or a combination thereof. The chemical sensitizer may be a sulfur compound or gold compound. The anti-foggant or stabilizer may be selected from among known anti-foggants or stabilizers: e.g., azoles such as a benzothiazolium salt, nitroindazole, nitrobenzimidazole, chlorobenzimidazole, bromobenzimidazole, mercaptothiazole, mercaptobenzothiazole, mercaptobenzimidazole, mercaptothiadiazole, aminotriazole, benzotriazole, nitrobenzotriazole and mercaptotetrazole (particularly, 1-phenyl-5-mercaptotetrazole); mercaptopyrimidines; mercaptotriazines; thioketo compounds such as oxazolinethion; azaindenes such as triazaindene, tetrazaindenes (particularly, 4-hydroxy-substituted (1,3,3a,7)tetrazaindenes), and pentazaindenes; benzenethiosulfonic acid, benzenesulfinic acid and benzenesulfonic acid amide. Other examples of useful anti-foggants or stabilizers are described in U.S. Pat. Nos. 3,954,474, 3,982,947, and Japanese Patent Publication No. 28660/77.

Advantages are obtained by using gelatin as a binder or protective colloid for any photographic emulsion, but other hydrophilic colloids may also be used. Examples of such hydrophilic colloid are proteins such as gelatin derivatives, gelatins grafted with other polymers, albumin, and casein; cellulose derivatives such as hydroxyethyl cellulose, carboxymethyl cellulose, and cellulose sulfate ester, saccharide derivatives such as sodium alginate and starch derivative; and hydrophilic homopolymers or copolymers, e.g., polyvinyl alcohol, polyvinyl alcohol having acetal groups incorporated therein, poly-N-vinyl pyrrolidone, polyacrylic acid, polymethacrylic acid, polyacrylamide, polyvinyl imidazole and polyvinyl pyrazole.

The gelatin may be lime-processed gelatin, acid-processed gelatin or enzyme-processed gelatin of the type described in *Bull. Soc. Sci. Phot. Japan, No.* 16, p. 30 (1966). Hydrolyzed or enzyme-decomposed gelatin may also be used.

Examples of surfactants which may be used include nonionic surfactants such as saponin (steroid), alkylene oxide derivatives (e.g., polyethylene glycol, polyethylene glycol/polypropylene glycol condensate, polyethylene glycol alkyl or alkyl aryl ether, polyethylene glycol esters, polyethylene glycol sorbitan esters, polyalkylene glycol alkylamines or alkylamides, and polyethylene oxide adducts with silicone), glycidol derivatives (e.g., alkenylsuccinic polyglyceride and alkylphenol polyglyceride), aliphatic acid esters of polyhydric alcohols, alkyl esters of saccharides, and urethanes or ethers of saccharides; anionic surfactants containing an acidic group such as a carboxyl, sulfo, phospho, sulfate ester or phosphate ester group such as triterpenoid-saponin, alkylcarboxylate salts, alkylsulfonate salts, alkylbenzenesulfonate salts, alkylnaphthalenesulfonate salts, alkyl sulfate esters, alkyl phosphate esters, N-acyl-N-alkyl taurines, sulfosuccinate esters, sulfoalkyl polyoxyethylenealkylphenyl ethers, and polyoxyethylenealkyl phosphate esters; amphoteric surfactants such as amino acids aminoalkylsulfonic acids, aminoalkylsulfuric or phosphoric acid esters, alkylbetaines, amine imides, and amine oxides; and cationic surfactants such as alkylamine salts, aliphatic or aromatic quaternary ammonium salts, heterocyclic quaternary ammonium salts such as pyridinium and imidazolium salts, and aliphatic or heterocyclic phosphonium or sulfonium salts.

Useful dyes include oxonol dyes, hemioxonol dyes, styryl dyes, merocyanine dyes, cyanine dyes and azo dyes. Of these dyes, oxonol dyes, hemioxonol dye and merocyanine dye are particularly advantageous. Specific examples of useful dyes are described in British Pat. Nos. 584,609, 1,177,429, Japanese Patent Application (OPI) Nos. 85130/73, 99620/74, 114420/74, 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

Useful spectral sensitizing dyes include cyanine dyes, merocyanine dyes, complex cyanine dyes, complex merocyanine dyes, holopolar cyanine dyes, hemicyanine dyes, styryl dyes and hemioxonol dyes. Particularly advantageous dyes are those referred to as cyanine dyes, merocyanine dyes and complex merocyanine dyes. Any nucleus that is usually used in cyanine dyes as a basic heterocyclic nucleus can be applied to these days. Illustrative nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei wherein the above listed nuclei are condensed with an alicyclic hydrocarbon ring; nuclei wherein these nuclei are condensed with an aromatic hydrocarbon ring, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be substituted on a carbon atom.

To a merocyanine dye or complex merocyanine dye, a nucleus having a ketomethylene structure such as a 5- to 6-membered heterocyclic nuclei (e.g., a pyrozoline-5-one nucleus, a thiohydantoin nucleus, a 2-thioxazolidine-2,4-dione nucleus, a thiazolidine-2,4-dione nucleus, a rhodanine nucleus, and a thiobarbituric acid nucleus) may be so used.

Known open-chain ketomethylene couplers may be used as yellow couplers. Benzoyl acetanilide and pivaloyl acetanilide compounds are used with advantage.

Pyrazolone compounds, indazolone compounds and cyanoacetyl compounds may be used as a magenta coupler; pyrazolone compounds are particularly preferred.

Phenol or naphthol compounds may be used as a cyan coupler.

Examples of polymer latices include polymers wherein the monomer component is an alkyl (meth)acrylate, alkoxyalkyl (meth)acrylate, glycidyl (meth)acrylate, (meth)acrylamide, vinyl esters (e.g., vinyl acetate), acrylonitrile, olefins and styrene which can be used independently or as a mixture thereof, or which may be combined with acrylic acid, methacrylic acid, $\alpha,\beta$-unsaturated dicarboxylic acid, hydroxyalkyl (meth)acrylate, sulfoalkyl (meth)acrylate and styrene sulfonic acid.

Useful anti-foggants include hydroquinone derivatives, aminophenol derivatives, gallic acid derivatives and ascorbic acid derivatives. Illustrative anti-foggants are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77 and Japanese Patent Publication No. 23813/75, etc.

Examples of the useful UV absorbants include aryl-substituted benzotriazole compounds (e.g., as described in U.S. Pat. No. 3,533,794), 4-thiazolidone compounds (e.g., as described in U.S. Pat. Nos. 3,314,794 and 3,352,681), benzophenone compounds (e.g., as described in Japanese Patent Application (OPI) No. 2784/71), cinnamate esters (e.g., as described in U.S. Pat. Nos. 3,705,805 and 3,707,375), butadiene compounds (e.g., as described in U.S. Pat. No. 4,045,229) and benzoxazole compounds (e.g., as described in U.S. Pat. No. 3,700,455). Other suitable examples thereof are described in U.S. Pat. No. 3,499,762 and Japanese Patent Application (OPI) No. 48535/79. UV absorbing couplers (e.g., $\alpha$-naphthol cyan dye forming coupler) and UV absorbing polymers may also be used.

Useful anti-discoloration agents include hydroquinone derivatives as described in U.S. Pat. Nos. 2,360,290, 2,418,613, 2,675,314, 2,701,197, 2,704,713, 2,728,659, 2,732,300, 2,735,765, 2,710,801, 2,816,028 and British Pat. No. 1,363,921; gallic acid derivatives as described in U.S. Pat. Nos. 3,457,079 and 3,069,262; p-alkoxyphenols as described in U.S. Pat. Nos. 2,735,765 and 3,698,909, Japanese Patent Publication Nos. 20977/74 and 6623/77; p-oxyphenol derivatives as described in U.S. Pat. Nos. 3,432,300, 3,573,050, 3,574,627 and 3,764,337, Japanese Patent Application (OPI) Nos. 35633/77, 147434/77 and 152225/77; and bisphenols as described in U.S. Pat. No. 3,700,455.

This invention is now described in greater detail by reference to the following examples which are given here for illustrative purposes only and are by no means intended to limit the scope of the invention.

EXAMPLE 1

The compounds used in the present invention were added to a 7 weight% of gelatin solution in amounts given in Table 1 below, coated uniformly on a subbed polyethylene terephthalate support in a dry thickness of about 7 microns and dried to prepare samples. These samples were stored for 1 day, 7 days, and 14 days at 25° C. and 50% RH. Part of each sample was immersed in water at 25° C. for 5 minutes and the degree of swelling Q represented by the following formula was measured:

$$Q = \frac{\text{thickness of swollen film}}{\text{thickness of dry film}}$$

Also, each sample was immersed in water at 25° C. for 5 minutes and a sapphire needle having a radius of 0.3 mm passed against the surface of the sample and moved in parallel to that surface at a rate of 2 mm per second. The load on the needle was changed continuously in the range of from 0 to 200 g. The amount of load necessary to scratch the surface of the film sample was measured. The results of measurement of Q and the scratch-causing load are set forth in Table 1 below. In the comparison example 1 in Table 1, the polymeric hardening agent having a portion which corresponds to L of the present invention, but having a short size as described in U.S. Pat. No. 4,161,407 was used.

TABLE 1

| Compound | Amount Added m eq. of Reactive Group/ 100 g Dry Gelatin) | Q 1 Day | Q 7 Days | Q 14 Days | Scratch Resistance (14 Days Storage) (g) |
|---|---|---|---|---|---|
| Control | 0 | 10.1 | 10.0 | 10.2 | 6 |
| P-1 | 6 | 5.1 | 3.3 | 3.0 | 95 |
| P-3 | 6 | 6.3 | 4.1 | 3.6 | 72 |
| Comparison | 6 | 10.1 | 8.7 | 7.1 | 18 |

TABLE 1-continued

| Compound | Amount Added m eq. of Reactive Group/ 100 g Dry Gelatin) | Q 1 Day | Q 7 Days | Q 14 Days | Scratch Resistance (14 Days Storage) (g) |
|---|---|---|---|---|---|
| Example 1* | | | | | |

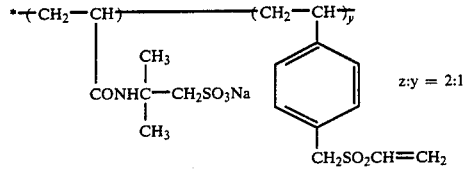

As is apparent from the results shown in Table 1 above, the polymers having a long L according to the present invention are water-soluble, are excellent hardening agents processing a fast hardening action. Layers containing these hardening agents quickly reach a certain degree of hardening. Accordingly, they are substantially free from after-hardening.

EXAMPLE 2

A high speed negative photographic emulsion containing 120 g of gelatin and 65 g of silver iodobromide per kilogram of emulsion was prepared in a conventional manner. The compounds used in the present invention were added to the emulsion in the amounts indicated in Table 2 below. The emulsion was then coated uniformly on a subbed cellulose triacetate support in a dry thickness of 10 microns and dried to prepare samples. The samples were stored for 7 days at room temperature and the degree of swelling Q was measured in the same manner as Example 1, after the samples were immersed for 5 minutes in water at 25° C. The resulting film samples were exposed through a wedge, developed with D-76 developer at 20° C., for 8 minutes, fixed, washed with water, dried and subjected to sensitometry to determine their sensitivity and degree of fogging. The results obtained are set forth in Table 2 below.

TABLE 2

| Compound | Amount Added (m eq. of Reactive Group/ 100 g of Dry Gelatin) | Photographic Characteristics: 7 Days Storage Relative Sensitivity | 7 Days Storage Fog | Enforced Condition at 50° C., 50% RH, 2 Days Relative Sensitivity | Enforced Condition Fog | Film Strength: Q 7 Days Storage | Scratch Resistance 7 Days Storage |
|---|---|---|---|---|---|---|---|
| Control | 0 | 100 | 0.05 | 100 | 0.12 | 9.9 | 7 |
| P-1 | 10 | 92 | 0.04 | 90 | 0.08 | 2.9 | 122 |
| P-3 | 10 | 94 | 0.04 | 92 | 0.09 | 3.1 | 113 |

As is apparent from the results shown in Table 2 above, the compounds according to the present invention provide a film strength sufficient for practical purposes and did not impair the photographic characteristics.

While the invention has been described in detail and with reference to specific embodiments thereof, it will be apparent to one skilled in the art that various changes and modifications can be made therein without departing from the spirit and scope thereof.

What is claimed is:

1. A photographic element having at least one light-sensitive silver halide emulsion layer, said element having at least one layer containing gelatin and a polymer which is a gelatin hardener, the polymer having a repeating unit of the formula (I):

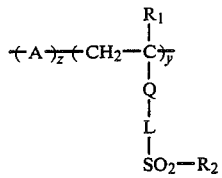

(I)

wherein A is a monomer unit prepared by copolymerizing copolymerizable ethylenically unsaturated monomers; $R_1$ is hydrogen or a lower alkyl group having 1 to 6 carbon atoms; Q is

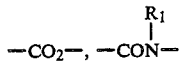

(wherein $R_1$ is the same as defined above) or a phenylene group; L is a divalent group having 3 to 15 carbon atoms and containing at least one linking group selected from the members consisting of

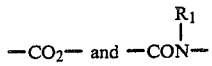

(wherein $R_1$ is the same as defined above) or a divalent group having 1 to 12 carbon atoms and containing at least one linking group of $SO_2$; $R_2$ is $—CH=CH_2$ or $—CH_2CH_2X$ (wherein X is a group capable of being substituted with a nucleophilic group or a group capable of being released in the form of HX upon reaction with a base); and z and y each represents molar percent, z being between 0 and 75 and y being between 25 and 100.

2. The photographic element as in claim 1, wherein A is ethylene, propylene, 1-butene, isobutene, styrene, chloromethylstyrene, hydroxymethylstyrene, sodium vinyl benzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids, ethylenically unsaturated mono- or dicarboxylic acids and salts thereof, maleic anhydride, esters of ethylenically unsaturated monocarboxylic or dicarboxlic acids, or amides of ethylenically unsaturated monocarboxylic or dicarboxylic acids.

3. The photographic element as in claim 1 wherein A is a cationic monomer or an anionic monomer.

4. The photographic element as in claim 1, wherein A is a cationic monomer.

5. The photographic element as in claim 1, wherein A is an ionic monomer, acrylamide or N-vinyl pyrrolidone.

6. The photographic element as in claim 1, wherein A is a monomer having at least two copolymerizable ethylenically unsaturated groups.

7. The photographic element as in claim 6, wherein A is divinyl benzene, methylenebisacrylamide, ethylene glycol diacrylate, trimethylene glycol diacrylate, ethylene glycol dimethacrylate, trimethylene glycol dimethacrylate or neopentyl glycol dimethacrylate.

8. The photographic element as in claim 1, wherein the lower alkyl group for $R_1$ is a methyl group, an ethyl group, a butyl group or an n-hexyl group.

9. The photographic element as in claim 1, wherein $R_1$ is a hydrogen atom or a methyl group.

10. The photographic light-sensitive material as in claim 1, wherein Q is $$-CO_2-,\ -CONH-,\ -\overset{CH_3}{\overset{|}{C}}ON-,\ -\overset{C_2H_5}{\overset{|}{C}}ON-,\ -\overset{nC_4H_9}{\overset{|}{C}}ON-,$$

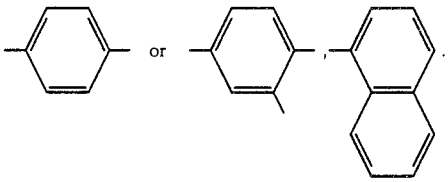

11. The photographic element as in claim 1, wherein Q is

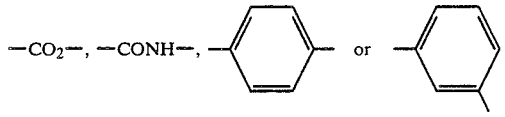

12. The photographic element as in claim 1, wherein L is selected from the group consisting of: $-CH_2CO_2CH_2-$, $-CH_2CO_2CH_2CH_2-$, $-CH_2CH_2CO_2CH_2CH_2-$, $-CH_2-_5CO_2CH_2CH_2-$, $-CH_2-_{10}CO_2CH_2C_2-$, $-CH_2NHCOCH_2-$, $-CH_2NHCOCH_2CH_2-$, $-CH_2-_3NHCOCH_2CH_2-$, $-CH_2-_5NHCOCH_2CH_2-$, $-CH_2-_{10}NHCOCH_2CH_2-$, $SO_2CH_2CH_2-$, $-SO_2CH_2CH_2SO_2CH_2CH_2-$ $$-SO_2CH_2CH_2SO_2CH_2\underset{\underset{OH}{|}}{C}HCH_2,$$

$-SO_3CH_2CO_2CH_2CH_2-$, $-SO_3CH_2CH_2CO_2CH_2CH_2-$, $-SO_2NHCH_2CO_2CH_2CH_2-$, $-SO_2NHCH_2CH_2CO_2CH_2CH_2-$, $-NHCONHCH_2CH_2-$, $-CH_2NHCONHCH_2CH_2-$, $-NHCO_2CH_2CH_2-$, 13 $CH_2NHCO_2CH_2CH_2-$.

13. The photographic element as in claim 1, wherein $R_2$ is selected from the group consisting of:

$-CH{=}CH_2$, $-CH_2CH_2Cl$, $-CH_2CH_2Br$, $-CH_2CH_2O_3SCH_3$,

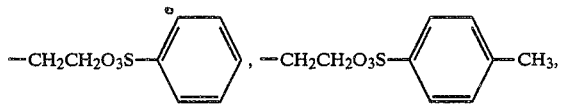

$-CH_2CH_2OH$, $-CH_2CH_2O_2CCH_3$, $-CH_2CH_2O_2CCF_3$, $-CH_2CH_2O_2CCHCl_2$.

14. The photographic element as in claim 1, wherein $R_2$ is selected fron the group consisting of $-CH{=}CH_2$, $-CH_2CH_2Br$, $-CH_2CH_2Cl$ or

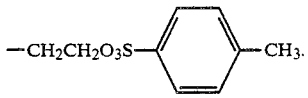

15. The photographic element as in claim 1, wherein the polymer contains from $0.5\times10^{-3}$ to $5\times10^{-2}$ equivalent of vinyl sulfone group per 100 g of dry gelatin.

16. The photographic element as in claim 1, wherein the polymer contains from $5\times10^{-3}$ to $5\times10^{-2}$ equivalent to vinyl sulfone group per 100 g of dry gelatin.

* * * * *